US007028527B2

(12) United States Patent
Ishibashi et al.

(10) Patent No.: US 7,028,527 B2
(45) Date of Patent: Apr. 18, 2006

(54) WORKPIECE PROCESSING SYSTEM AND METHOD OF RECONFIGURING A WORKPIECE PROCESSING SYSTEM

(75) Inventors: Shigeo Ishibashi, Kanagawa (JP); Duane Depweg, Tipp City, OH (US); Curtis Smith, New Carlisle, OH (US)

(73) Assignee: Aida Engineering Ltd., Kanagawa (JP)

( * ) Notice: Subject to any disclaimer, the term of this patent is extended or adjusted under 35 U.S.C. 154(b) by 301 days.

(21) Appl. No.: 10/391,045

(22) Filed: Mar. 18, 2003

(65) Prior Publication Data

US 2004/0183245 A1 Sep. 23, 2004

(51) Int. Cl.
*B21D 43/05* (2006.01)
*B21D 43/20* (2006.01)

(52) U.S. Cl. ..... 72/405.08; 72/405.01; 100/207

(58) Field of Classification Search ..... 72/405.08, 72/405.11, 405.01, 405.13; 100/207; 198/621.1; 414/744.2, 744.4, 744.6, 749.1
See application file for complete search history.

(56) References Cited

U.S. PATENT DOCUMENTS 3,170,262 A * 2/1965 Hall ..... 43/15
4,557,134 A * 12/1985 Kuppinger ..... 72/405.05
4,706,532 A 11/1987 Hashimoto
4,713,961 A * 12/1987 Hoehn et al. ..... 72/419
5,131,256 A * 7/1992 Sofy ..... 72/405.13
5,327,768 A 7/1994 Yamashita
5,423,202 A 6/1995 Komatsu et al.
5,483,876 A * 1/1996 Davis et al. ..... 100/207
5,676,014 A 10/1997 Sanford
5,802,967 A 9/1998 Thudium et al.
5,899,109 A 5/1999 Fisch
5,983,696 A 11/1999 Maher
5,992,209 A 11/1999 Hofele et al.
6,185,979 B1 2/2001 Schollhammer

* cited by examiner

*Primary Examiner*—Daniel C. Crane
(74) *Attorney, Agent, or Firm*—Wood, Phillips, Katz, Clark & Mortimer

(57) ABSTRACT

A workpiece processing system having, a first assembly for performing at least a first processing operation on a workpiece at a first location and having a frame, a nesting assembly, a bolster assembly upon which a workpiece can be supported at the first processing location, and a transfer assembly. The bolster assembly is repositionable relative to the frame by movement along a first path between first and second positions.

The transfer assembly is capable of moving a workpiece to/from the first processing location along a second path from/to the nesting assembly. The nesting assembly has first and second workpiece support elements, each with a length. The first and second workpiece support elements are each repositionable relative to the bolster assembly between a) an operating orientation wherein the lengths of the first and second workpiece support elements project generally in the direction of the second path, and b) a stored orientation. The first and second workpiece support elements have a lesser projection along the second path with the first and second workpiece support elements in their stored orientation than with the first and second workpiece support elements in their operating orientation. At least one of the first and second workpiece support elements is repositionable relative to the bolster assembly to a pre-storage position wherein the first and second workpiece support elements do not interfere with each other as the other of the first and second workpiece support elements is changed from its operating orientation into its stored orientation.

24 Claims, 7 Drawing Sheets

WORKPIECE PROCESSING SYSTEM AND METHOD OF RECONFIGURING A WORKPIECE PROCESSING SYSTEM

BACKGROUND OF THE INVENTION

1. Field of the Invention

This invention relates to workpiece processing systems of the type in which workpieces are moved in a path and serially processed and, more particularly, to a nesting assembly which receives workpieces as they are moved in the processing path. The invention is also directed to a method of reconfiguring the workpiece processing system.

2. Background Art

Transfer workpiece processing systems are widely used to form different types of workpieces. This transfer processing technology is commonly employed with press equipment. In these systems, workpieces are moved in a path with different processing operations performed serially thereon as the workpieces advance. Typically, the workpieces are shuttled between different assemblies, each capable of performing different processing operations on the workpieces. Each such assembly typically has a frame which bounds a working space within which the workpieces are processed. In a press environment, a bolster is provided to support workpieces in the processing space. The bolster is also designed to support processing components, such as forming dies. A plurality of bolsters with different processing capabilities are interchangeably mountable on each of the processing assemblies. To effect this interchange, the bolsters are maneuvered through a frame opening that may be defined between spaced columns that are part of the frame. The bolsters have an associated nesting assembly which facilitates the transfer of workpieces through the frame to an appropriate pickup location, from where the workpieces may be transferred to a shuttle mechanism for conveyance to another processing assembly, as through another nesting assembly, or to another desired point of use.

Commonly, the nesting assemblies are constructed utilizing paired, elongate workpiece support elements which bridge the undersides of workpieces so as to provide a support therefor. The workpiece support elements are mounted to the bolster so as to be pivotable about parallel, vertically extending axes, between an operating orientation, wherein the lengths of the workpiece supports project generally in the line of the workpiece processing path, and a stored orientation. In their operating orientation, the workpiece support elements project through the frame to situate the workpieces at a conveniently accessible location to facilitate transfer therefrom. By placing the workpiece support elements in their stored orientation, the extension of the workpiece support elements in a direction along the conveyance path is reduced, thereby reducing the requisite dimensions of the frame opening to allow passage therethrough of the bolster with the nesting assembly thereon.

Heretofore, the elongate workpiece support elements have been relatively situated so that arcs traced by the distal ends of the workpiece support elements intersect as the workpiece support elements are moved between their operating and stored orientations. As a consequence, the degree of compaction of the workpiece support elements is limited to that at which the workpiece support elements interfere as they are moved from their operating orientation towards their stored orientation. This interference will typically prohibit a full 90° of pivoting of the elongate workpiece support elements from their operating orientation, which would otherwise represent a more compact relationship between the workpiece support elements and the bolster in the line of the processing path. As a consequence, the opening through the frame to accommodate the bolster and nesting assembly must be made larger than it would have to be made in the event that the workpiece support elements could be pivoted through, or beyond, 90° from their operating orientation.

Designers of these systems strive to produce bolster/nesting assembly combinations that are as compact as possible without compromising performance. The industry constantly seeks ways to improve existing designs in this regard.

SUMMARY OF THE INVENTION

In one form, the invention is directed to a workpiece processing system having a first assembly for performing at least a first processing operation on a workpiece at a first location and having a frame, a nesting assembly, a bolster assembly upon which a workpiece can be supported at the first processing location, and a transfer assembly. The bolster assembly is repositionable relative to the frame by movement along a first path between first and second positions. The transfer assembly is capable of moving a workpiece to/from the first processing location along a second path from/to the nesting assembly. The nesting assembly has first and second workpiece support elements, each with a length. The first and second workpiece support elements are each repositionable relative to the bolster assembly between a) an operating orientation wherein the lengths of the first and second workpiece support elements project generally in the direction of the second path, and b) a stored orientation. The first and second workpiece support elements have a lesser projection along the second path with the first and second workpiece support elements in their stored orientation than with the first and second workpiece support elements in their operating orientation. At least one of the first and second workpiece support elements is repositionable relative to the bolster assembly to a pre-storage position wherein the first and second workpiece support elements do not interfere with each other as the other of the first and second workpiece support elements is changed from its operating orientation into its stored orientation.

In one form, the first and second workpiece support elements are movable respectively around first and second axes relative to the bolster assembly in changing from their operating orientation into their stored orientation.

The first and second axes may be substantially parallel to each other.

In one form, the second path extends substantially parallel to a first line and the first and second axes are substantially orthogonal to the first line.

In one form, one of the first and second workpiece support elements is repositionable relative to the other of the first and second workpiece support elements so that the spacing between the first and second axes can be changed.

In one form, the first and second workpiece support elements are translatable relative to the bolster assembly along a line so that the spacing between the first and second axes can be changed.

In one form, the first and second workpiece support elements have first and second free ends, respectively spaced from the first and second axes, which trace first and second arcs as the first and second workpiece support elements move around the first and second axes between their operating and stored orientations. The first and second workpiece support elements are relatively repositionable between a pre-storage relationship and an operative relationship. With the first and second workpiece support elements in the pre-storage relationship, the first and second arcs do not intersect. With the first and second workpiece elements in the operative relationship, the first and second arcs do intersect.

In one form, the frame has a first opening through which the bolster assembly moves as the bolster assembly is changed between the first and second positions. The first and second workpiece support elements are movable with the bolster assembly as the bolster assembly is changed between the first and second positions. With the workpiece support elements in their operating orientation, the first and second workpiece support elements are situated so as to interfere with the frame in the event that the bolster assembly is moved between the first and second positions. With the first and second workpiece support elements in their stored orientation, the first and second workpiece support elements do not interfere with the frame as the bolster assembly is moved between the first and second positions.

In one form, the first and second workpiece support elements each have a cantilevered construction with a free end. The workpiece processing system further includes a bracket that is supportingly abuttable to the workpiece support elements adjacent to the free ends of the workpiece support elements with the workpiece support elements in their operating orientation.

In one form, the support bracket has an upwardly opening notch to receive the first workpiece support element.

In one form, the first workpiece support element is movable vertically relative to the support bracket to allow the notch to receive the first workpiece support element.

In one form, the bolster assembly is movable vertically relative to the frame and the first workpiece support element follows vertical movement of the bolster assembly.

In one form, the free end of the first workpiece support element has a depending portion which engages the support bracket.

The depending portion may have a notch to receive the support bracket.

The workpiece processing system may further include a second assembly for performing at least a second processing operation on a workpiece at a second processing location.

The processing system may further include a shuttle assembly for moving workpieces between the first and second assemblies.

The invention further contemplates the workpiece processing system in combination with a workpiece upon which processing can be performed through the workpiece processing system.

The invention is further directed to a method of reconfiguring a workpiece processing system of the type having: a frame; a first assembly for performing at least a first processing operation on a workpiece at a first processing location and comprising a frame; a nesting assembly having first and second workpiece support elements each having a length and respectively pivotable about first and second axes; a bolster assembly upon which a workpiece can be supported at the first processing location; and a transfer assembly capable of moving a workpiece to/from the first processing location along a first path from/to the nesting assembly. The method includes the steps of: placing the first and second workpiece support elements in an operating orientation wherein the lengths of the first and second workpiece support elements project generally in the direction of the first path; and repositioning at least one of the first and second workpiece support elements relative to the bolster other than by pivoting around the first and second axes to allow the first and second workpiece support elements to pivot from their operating orientation into their stored orientation without interfering with each other.

In one form, the step of repositioning at least one of the first and second support elements involves moving the first workpiece support element so that the spacing between the first and second axes is changed.

The step of repositioning at least one of the first and second support elements may involve translating the first and second workpiece support elements along a line.

The step of repositioning at least one of the first and second support elements may involve translating the first and second workpiece support elements along a line that is orthogonal to the first axis.

The method may further include the step of moving the bolster assembly and the nesting assembly as a unit relative to the frame along a second path that is transverse to the first path between a first position at the first processing location and a second position that is spaced from the first processing location with the first and second workpiece support elements in their stored orientation.

DETAILED DESCRIPTION OF THE DRAWINGS

Figure 1:
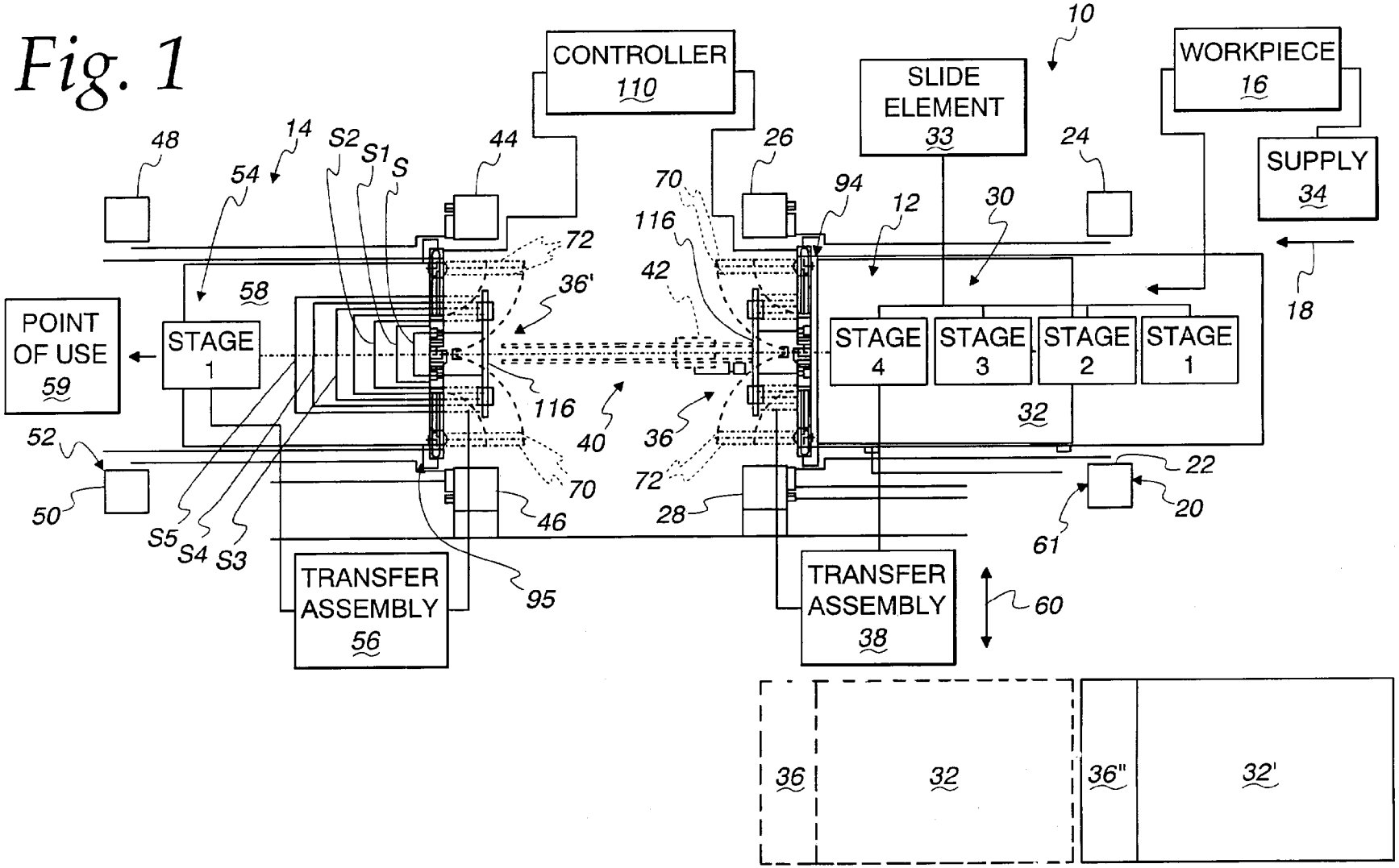
FIG. 1 is a partially schematic representation of a workpiece processing system incorporating nesting assemblies, according to the present invention, in association with two different processing assemblies.
Figure 2:
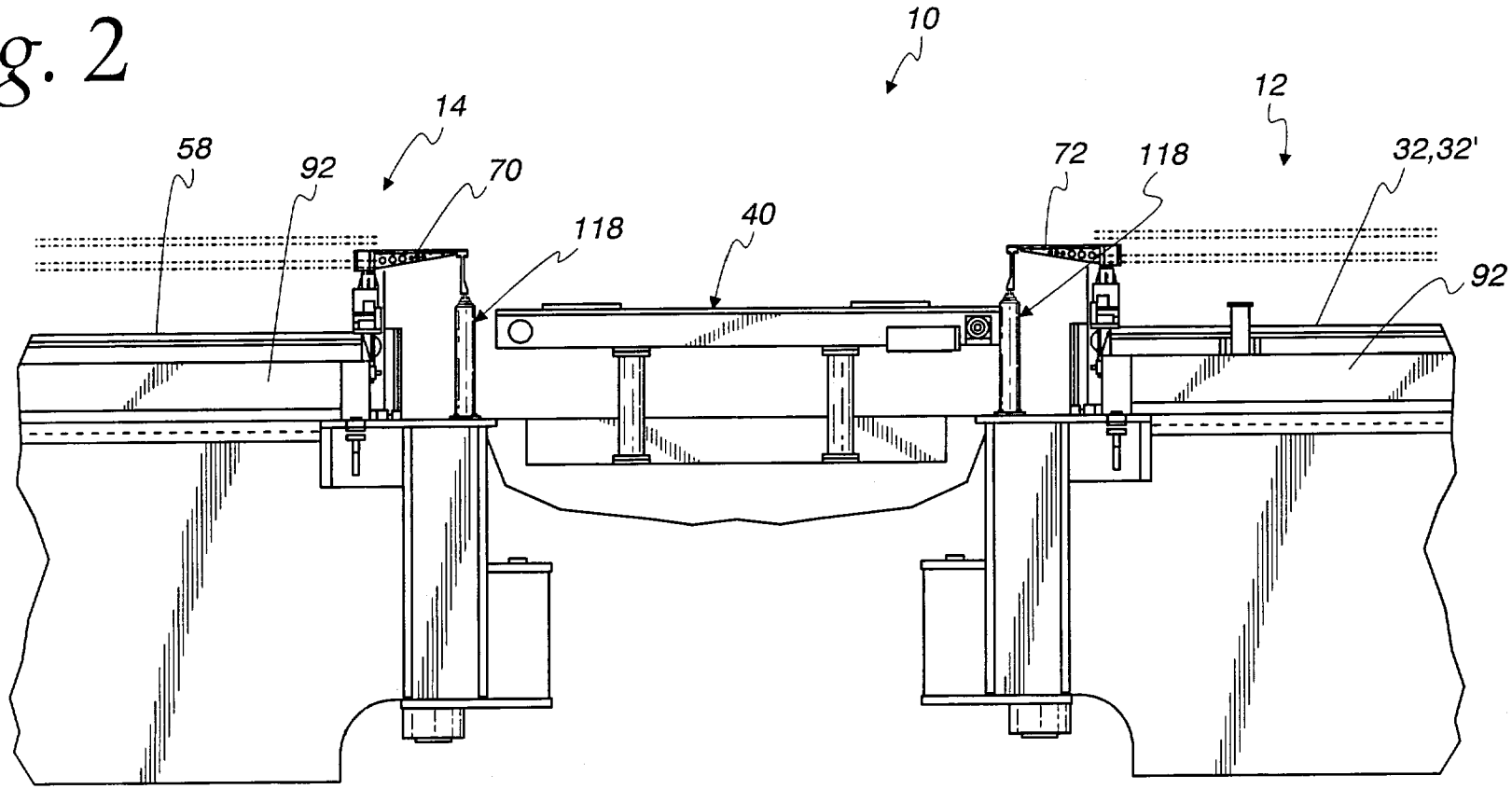
FIG. 2 is a fragmentary, front elevation view of a portion of each of the processing assemblies in FIG. 1 and showing an inventive nesting assembly, associated one each, with the different processing assemblies.

In FIG. 1, a generic representation of a workpiece processing system, according to the present invention, is shown at 10. It should be understood that the workpiece processing system 10 is but exemplary of myriad different system configurations into which the present invention can be incorporated. The processing system 10 consists of first and second processing assemblies 12,14. In this embodiment, the first processing assembly 12 has the capability of processing a workpiece 16 in multiple stages, as the workpiece 16 is advanced in a processing path from right to left in FIG. 1 in a line, as indicated by the arrow 18. In this embodiment, the processing is carried out in four stages (1–4) by the first processing assembly 12. The precise nature of the processing is not critical to the present invention. As just an example, the first processing assembly 12 may be a press which serially carries out different processing steps at the four stages.

The first processing assembly 12 has a frame 20, in this case including spaced, vertically extending columns 22,24, 26,28 which bound the perimeter of a squared processing space 30, as viewed from above. A bolster assembly 32 resides within the processing space 30 and supports the appropriate tooling/dies to carry out the processing steps at the four stages. The processing is actually conducted as a slide element 33, with complementary tooling/dies, is translated vertically towards and away from the bolster assembly 32.

In operation, workpieces 16 are continuously delivered from a supply 34 to the stage 1 processing location by movement between the columns 22,24. The workpieces 16 are conventionally advanced in the processing path through the four stages within the processing space 30. At the conclusion of the stage 4 processing, the workpieces 16 are delivered to a nesting assembly at 36 through a conventional-type transfer assembly 38. The nesting assembly 36 supports the workpieces 16 at a location between the columns 26,28 so as to be accessible for pickup by a shuttle assembly 40.

The shuttle assembly 40 has a shuttle carriage 42 which moves guidingly along the processing path from the nesting assembly 36 to a nesting assembly 36' at the upstream end of the second processing assembly 14. The nesting assembly 36' may be identical to the nesting assembly 36 but reversely oriented, as explained in greater detail below. The nesting assembly 36' accepts workpieces 16 from the shuttle carriage 42 at a location between spaced columns 44,46 which, in conjunction with columns 48,50, define part of a frame 52 which bounds a processing space 54 in the second processing assembly 14. Through a transfer assembly 56, the workpieces 16 are transferred from the nesting assembly 36' to within the processing space 54 for processing by appropriate tooling upon a bolster 58 at one or more stages (one shown—stage 1) within the processing space 54. At the conclusion of processing by the second processing assembly 14, the workpieces 16 are delivered by an appropriate means to a point of use 59, which might be a completed workpiece storage location, a staging area, or another processing assembly (not shown).

The bolster assembly 32 is movable as unit with the nesting assembly 36. To change the bolster assembly 32/nesting assembly 36 combination, or to facilitate access to the bolster assembly 32/nesting assembly 36 combination at a location externally of the processing space 30, the bolster assembly 32/nesting assembly 36 combination is designed to be changed between (a) a first operative position within the processing space 30 and (b) a second position, shown in dotted lines in FIG. 1, by movement of the bolster assembly 32/nesting assembly 36 combination in a generally linear path, indicated by the double-headed arrow 60, through an opening 61 in the frame 20 between the columns 22,28. The path identified by the arrow 60 is substantially orthogonal to the line of the workpiece processing path, indicated by the arrow 18. The mechanism through which the bolster assembly 32/nesting assembly 36 combination is repositioned is not critical to the present invention. It suffices to say that the bolster assembly 32/nesting assembly 36 combination can be repositioned to allow another bolster assembly 32'/nesting assembly 36" combination, with the same or different processing capabilities, to be substituted at the first location operatively within the processing space 30.

The bolster assembly 58 may be similarly associated with the second processing assembly 14 to allow removal thereof, in combination with the nesting assembly 36' from the processing space 54 in the second processing assembly 14, as for substitution by an appropriate bolster assembly/nesting assembly combination, or to facilitate access thereto.

The present invention is directed principally to the construction and operation of the nesting assemblies 36,36',36", as shown in detail in FIGS. 2–10. The nesting assembly 36,36',36" which may be identical in construction and will be treated as such herein, each consist of first and second workpiece support elements/arms 70,72, each having a length L (FIG. 7) which may be dictated by a particular application. The workpiece support element 70 is cantilever mounted to a base 74, which is mounted to a slide assembly 76 for pivoting movement relative to the slide assembly 76 around a vertically extending axis 78. The second workpiece support element 72 has a like base 74' mounted to a slide assembly 76' for pivoting movement relative thereto around a vertically extending axis 78'.

The slide assembly 76 is movably guidingly along an elongate beam 80 in a linear path, as indicated by the double-headed arrow 82. This linear path is substantially orthogonal to the processing path along which the workpieces 16 are moved to and through the first and second processing assemblies 12,14. The slide assembly 76' moves guidingly along a like, elongate beam 80' in the same path line. The slide assembly 76 has a rotary actuator 88 which is operable to cooperate with the guide beam 80 to selectively move the slide assembly 76 back and forth along the length thereof through a rodless cylinder arrangement. The slide assembly 76' has a like actuator 88' which is operable in a similar fashion to advance the slide assembly 76' back and forth along the length of the guide beam 80'.

The slide assembly 76 and its guide beam 80 and the slide assembly 76' and its guide beam 80' are respectively supported upon mounting brackets 90,90'. The mounting brackets 90,90' are adjustably secured to a carrier 92 for each bolster assembly 32, 32', 58, so as to maintain the guide beams 80,80' and slide assemblies 76,76' thereupon in an operative position, at the downstream end 94 of the bolster assembly 32, 32' and the upstream end 95 of the bolster assembly 58.

During operation of the processing system 10, the workpiece support elements 70,72 assume an operating orientation, as shown in FIGS. 1–5 and 7, wherein the lengths of the workpiece support element 70,72 project generally in the direction of the linear workpiece conveying/processing path, i.e., along a line indicated by the arrow 18. In the operating orientation, the workpiece support elements 70,72 cooperatively provide a bridging support at the underside of the workpieces 16. Suitable, L-shaped edge clips 96,96' are provided on the workpiece support elements 70,72, respectively; to confine shifting of a workpiece 16 that is supported on the workpiece support elements 70,72 transversely to the line of the conveying/processing path.

With the workpiece support elements 70,72 in their operating orientation, the workpiece support elements 70,72 on the bolster assembly 32 project from the downstream end 94 of the bolster assembly 32 to between the columns 26,28. In their operating orientation, the workpiece support elements 70,72 prohibit repositioning of the bolster assembly 32 between its first and second positions through the frame opening 61. As such, to permit the required movement of the bolster assembly 32 during a change or repositioning thereof between its first and second positions, the workpiece support elements 70,72 must be changed to a stored orientation. This is accomplished by pivoting the workpiece support elements 70,72 about their respective axes 78,78' towards each other in the direction indicated by the arrows 98,98' in FIGS. 3, 7 and 8. Depending upon the length L of the workpiece support elements 70,72 and their spacing S (FIG. 7), this pivoting reorientation may cause arcs A,A' (FIG. 8) traced by the free ends 100,100' of the workpiece support elements 70,72 to intersect. As a result, the workpiece support elements 70,72 interfere with each other to prevent a full 90° pivoting from their operating orientation, as would situate the workpiece support elements 70,72 in their most compact configuration, i.e., with minimal extension downstream beyond the downstream end 94 of the bolster assembly 32 and upstream beyond the upstream end 95 of the bolster assembly 58.

Figure 8:
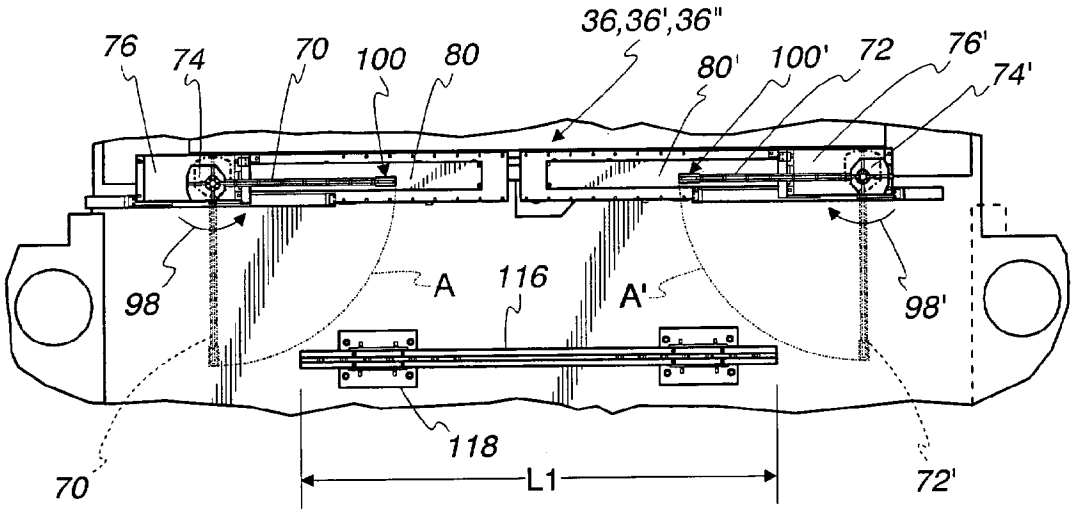
FIG. 8 is a fragmentary, plan view of one of the nesting assemblies in FIG. 7 and showing the workpiece support elements relatively situated in a pre-storage relationship in dotted lines, wherein they are spaced further from each other than in the operative relationship of FIG. 7, and with the workpiece support elements pivoted to a stored orientation in solid lines.
Figure 9:
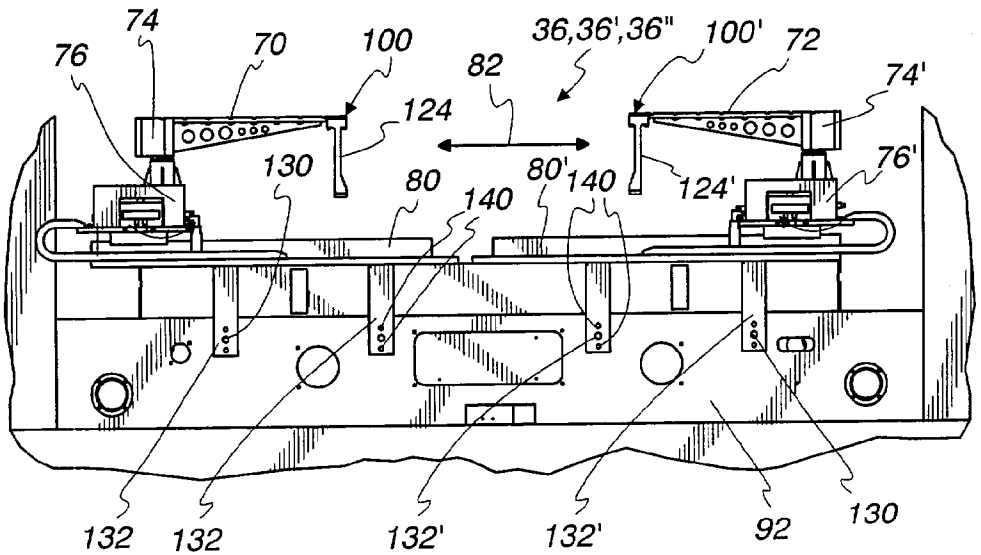
FIG. 9 is an end elevation view of the nesting assembly in the FIG. 8 state.

According to the invention, the slide assemblies 76,76' are operable to translate the workpiece support elements 70,72 away from each other thereby to increase the spacing between the axes 78,78' so that the arcs A,A' do not intersect thereby allowing pivoting through 90° to the stored orientation of FIGS. 8 and 9. By so translating the slide assemblies 76,76' to increase the spacing between the axes 78,78', the workpiece support elements 70,72 can be pivoted in predetermined paths, without interference, from their operating orientation through 90°, or more, compactly into their stored orientation. To accomplish this, it may be necessary to move only one slide assembly 76,76'. However, preferably, there is coordinated, simultaneous movement of both slide assemblies 76,76' to change the relationship of the workpiece support elements 70,72 between their operative relationship (FIG. 7) and pre-storage relationship (shown in dotted lines in FIG. 8).

Appropriate stops 106 (FIGS. 3 and 6) may be provided to limit the range of movement of the slide assemblies 76,76' towards and away from each other. Proximity/limit switches 108,109, shown for representative slide assembly 76', may also be provided to set the limits of the desired translating range for the slide assemblies 76,76', to avoid overtravel and/or to select a spacing S for the workpiece support elements 70,72, depending upon the operative workpiece configuration. For example, as shown in FIG. 1, five exemplary different spacings (S1-S5) are shown that may be selected or pre-programmed in a central controller 110.

Because of the cantilevered mounting of the workpiece support elements 70,72 on their respective bases 74,74', the free ends 100,100' of the workpiece support elements 70,72 are unsupported by the bolster assemblies 32, 32', 58. To reinforce the free ends 100,100', a support bracket 116 is provided at an elevated location upon a base 118 at a location downstream of the nesting assembly 36 and upstream of the nesting assembly 36'. Each support bracket 116 has an upright wall 120 with a plurality of notches 122 spaced strategically at paired, equal distances from the lengthwise center of the support bracket 116, to correspond with a desired spacing S for the slide assemblies 76,76', as hereinafter described, along the length thereof. The workpiece support elements 70,72 have depending portions/extensions 124,124' at the free ends 100,100' thereof. The extensions 124,124' have downwardly opening notches 126 to accept the upper edge 128 of the upright wall 120 on the support bracket 116.

The notches 122 on the support bracket 116 are situated to facilitate consistent selection of different desired operating spacings (S) for the workpiece support elements 70,72. To engage the extensions 124,124' with the support bracket 116, each bolster assembly 32,32',58 is raised before the workpiece support elements 70,72 are reoriented from their stored orientation into their operating orientation. With the bolster assembly 32,32',58 elevated, the workpiece support elements 70,72 can be pivoted to their operating orientation without interference between the depending extensions 124, 124' and the support brackets 116. By operating the slide assemblies 76,76', the desired spacing S between the workpiece support elements 70,72 is selected. Thereafter, the bolster assembly 32' is lowered, which causes the extensions 124,124' to nest in the aligned notches 122 in the upper edge 128 of the upright wall 120 and in turn the upper edge 128 to nest in the notches 126 so that the operating orientation of the workpiece support elements 70,72 is consistently and stably fixed.

Figure 3:
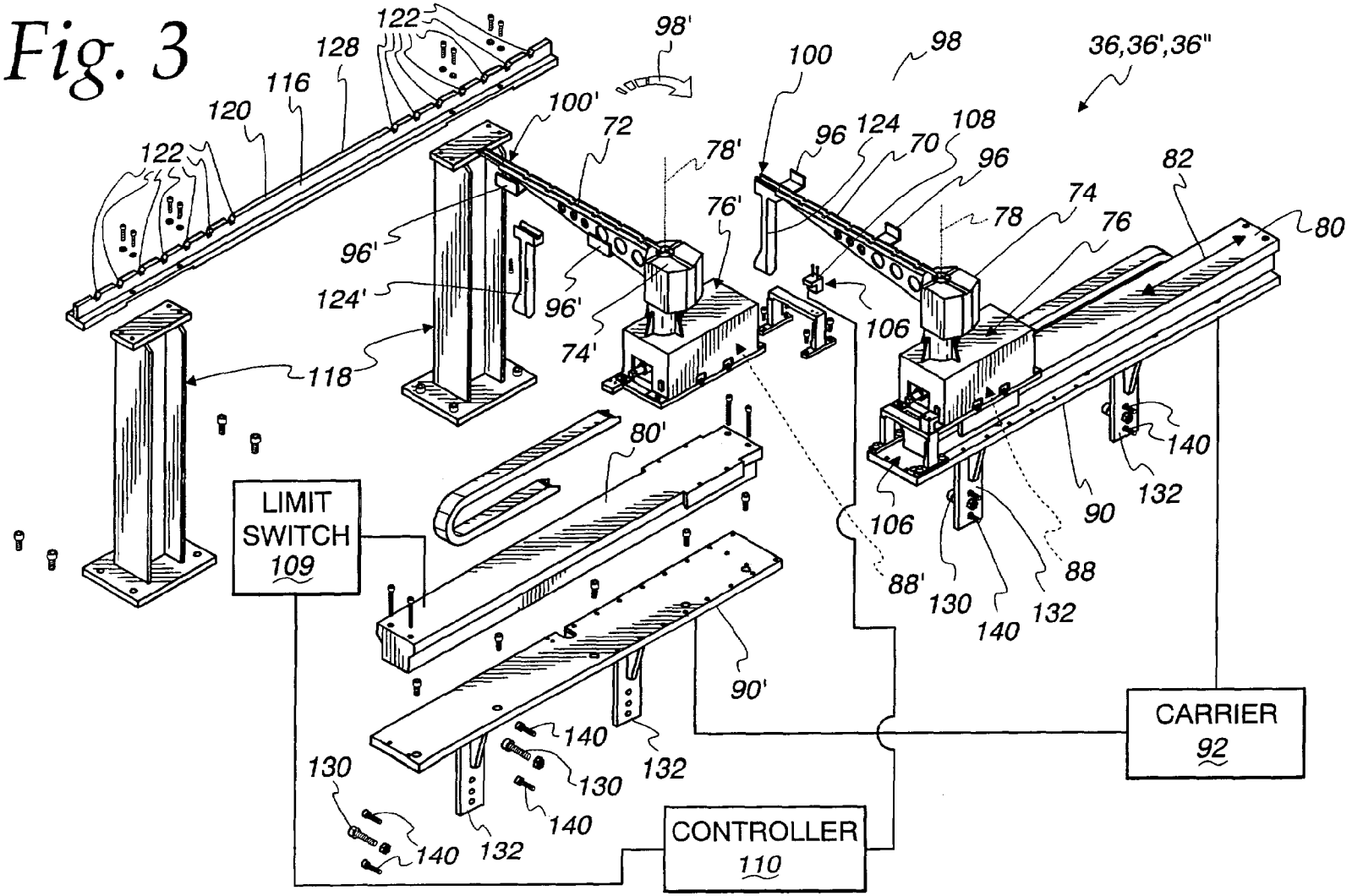
FIG. 3 is an exploded, perspective view of the inventive nesting assembly, as shown in FIGS. 1 and 2, with workpiece support elements thereon in an operating orientation so as to cooperatively support workpieces being processed.
Figure 4:
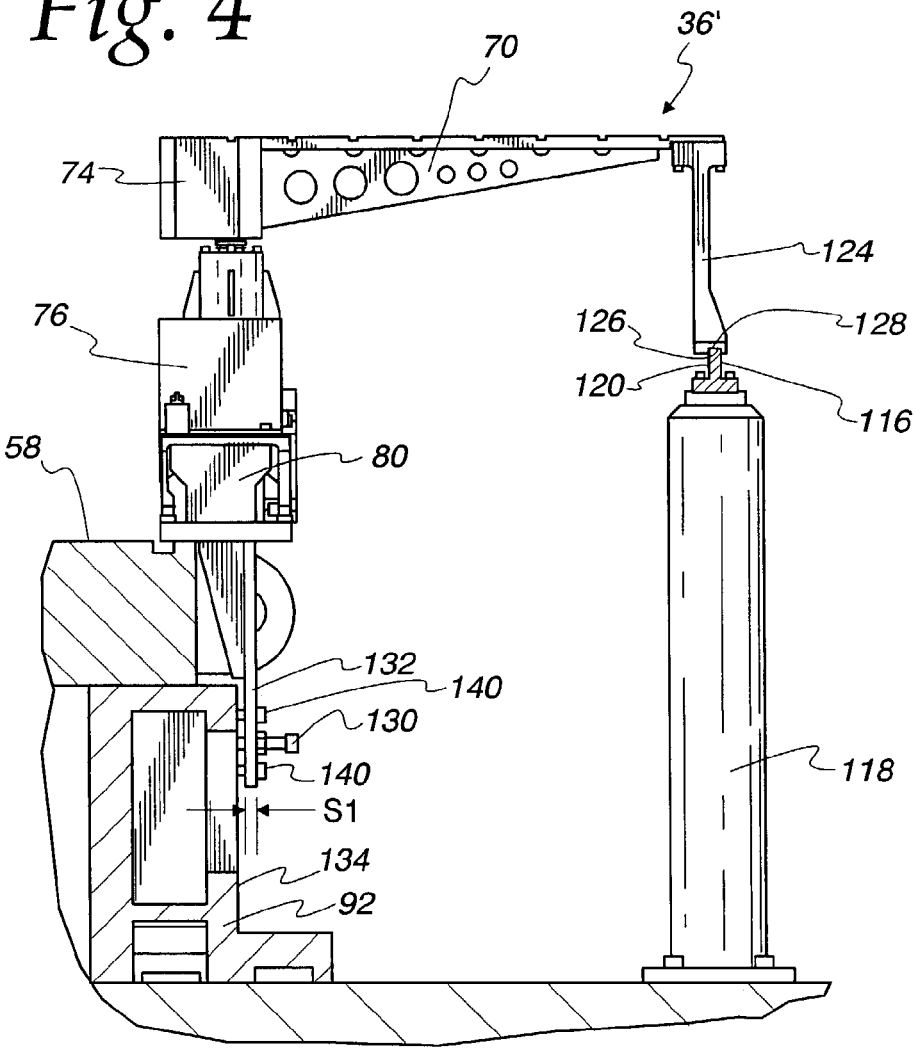
FIG. 4 is an enlarged, fragmentary, partial cross-sectional view of one of the nesting assemblies in FIG. 1–3.
Figure 6:
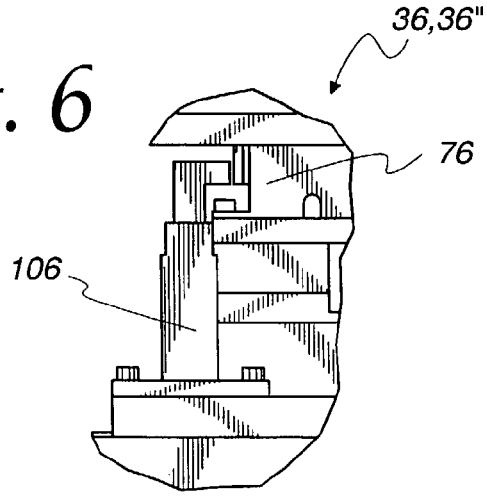
FIG. 6 is an enlarged, fragmentary, end elevation view of a system for stopping and monitoring the movement of slide assemblies carrying the workpiece support elements on the inventive nesting assemblies which occurs to vary the spacing between the workpiece support elements.
Figure 5:
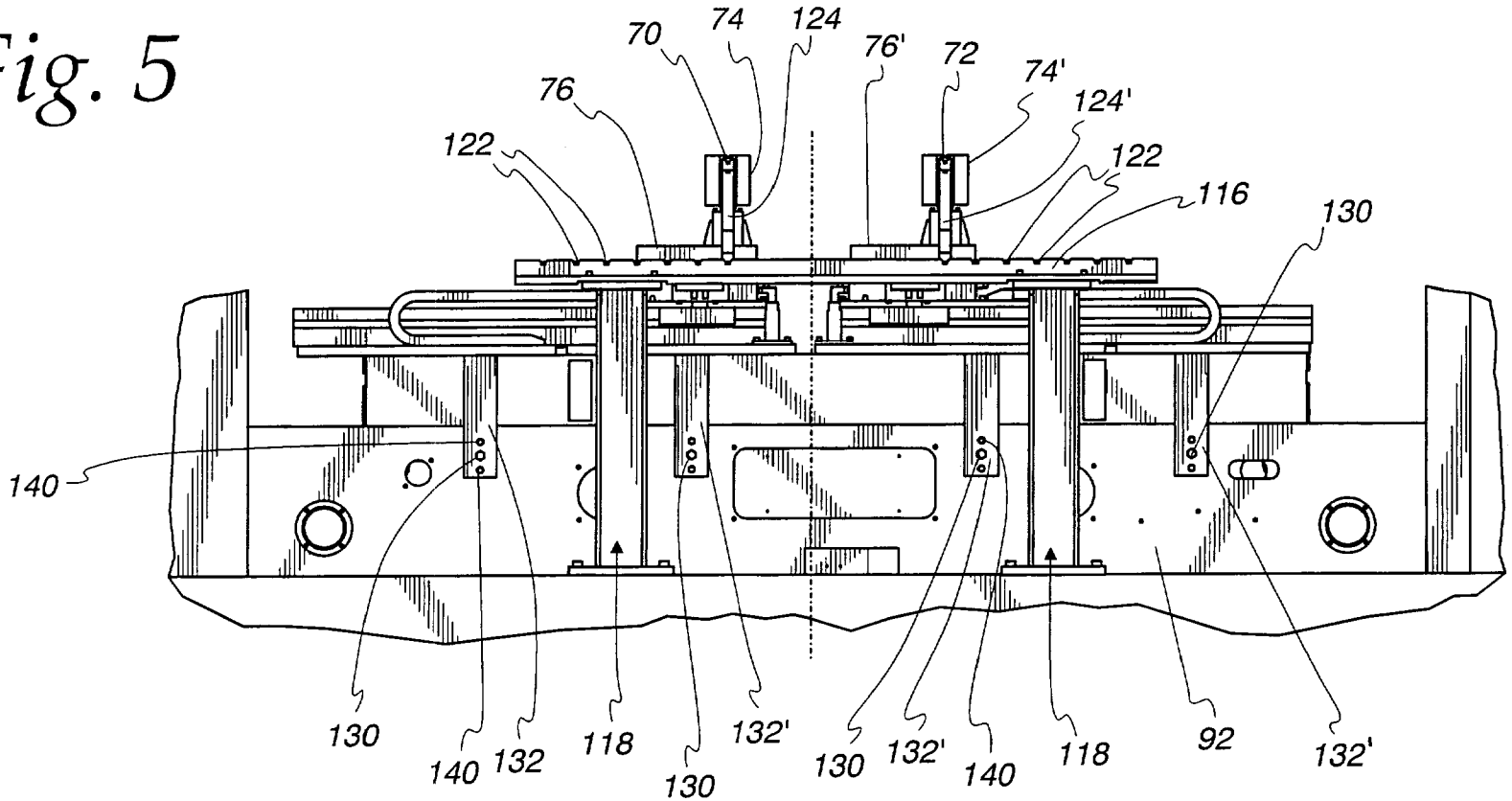
FIG. 5 is an end elevation view of one of the inventive nesting assemblies in FIGS. 1–4 with the workpiece support elements in their operating orientation.
Figure 7:
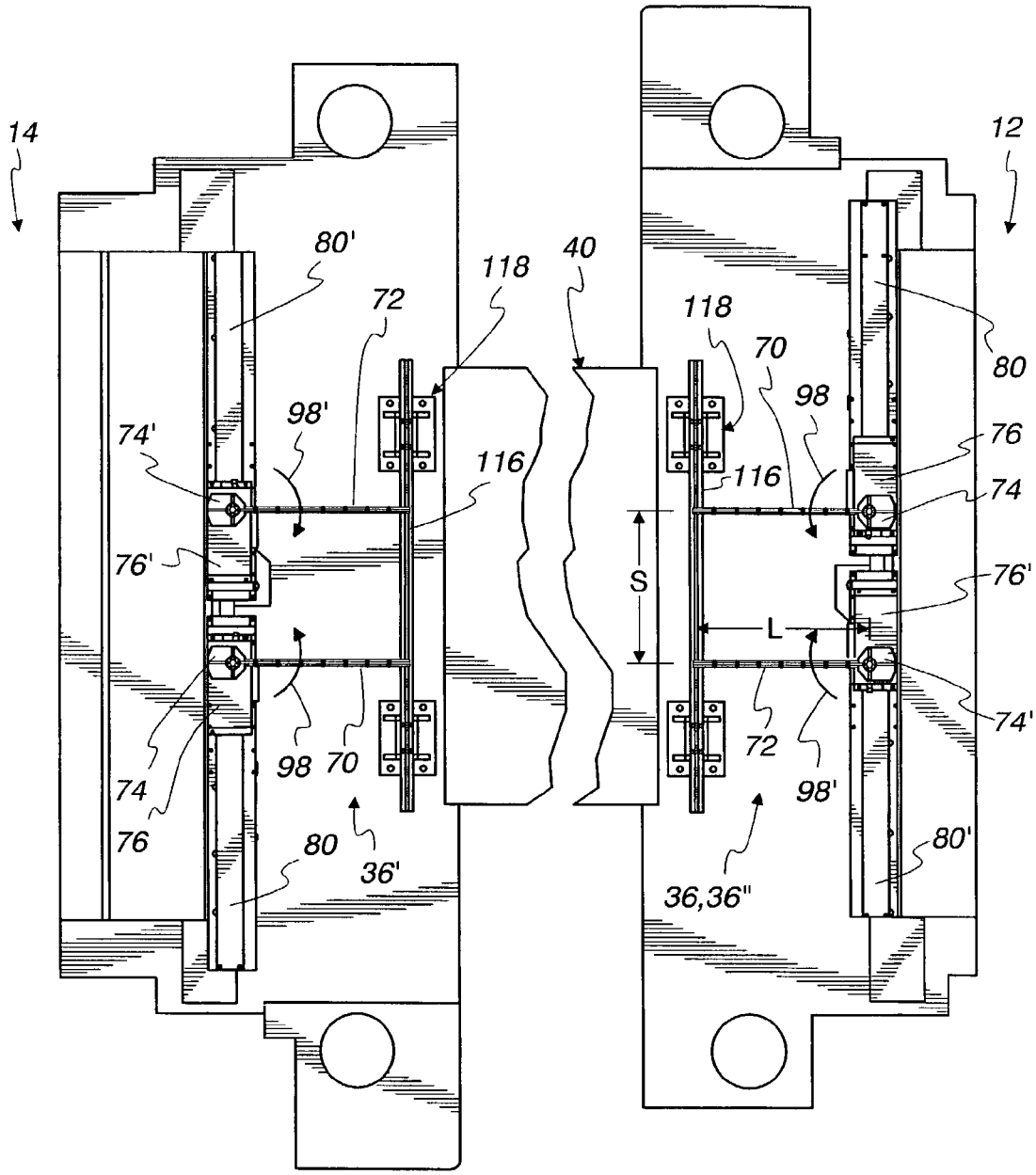
FIG. 7 is a fragmentary, plan view of the workpiece processing system in FIG. 1 and showing workpiece support elements on each of the nesting assemblies in an operating orientation.

To ensure the proper mating between the depending extensions 124,124' and the support brackets 116, an adjustment capability is incorporated into the mounting brackets 90,90'. More specifically, as seen in FIGS. 3 and 4, an adjustable spacing bolt 130 is provided on each of a pair or depending mounting bracket plates 132,132' on each mounting bracket 90,90'. The bolts 130 are repositionable to set a desired spacing Si between the mounting bracket plates 132 and an adjacent surface 134 on the carrier 92. By adjusting this spacing, alignment between the depending extensions 124,124' and support bracket 116 can be established. The desired spacing is maintained by two securing bolts 140, one each on top of and below the location of each spacing bolt 130.

As seen in FIG. 8 the support bracket 116 may be configured with a length L1 that allows the workpiece support elements 70,72, in their pre-storage relationship, shown in dotted lines, to pivot between their operating and stored orientations without causing the arcs A,A' to coincide with the support bracket 116, as viewed from overhead.

In operation, with the bolster assembly 32 in operative relationship with the first processing assembly 12, the workpiece support elements 70,72 are situated in their operative orientation. The bolster assembly 32 is then elevated to allow the depending extensions 124,124' to disengage from the support bracket 116, thereby allowing the workpiece support elements 70,72 to freely both translate and rotate. The slide assemblies 76,76' are then operated to place the workpiece support elements 70,72 in a pre-storage relationship, as seen in dotted lines in FIG. 8, wherein the workpiece support elements 70,72 can be pivoted about their respective axes 78,78' without intersection of the arcs A,A' traced by the free ends 100,100'. The workpiece support elements 70,72 are then pivoted to their stored orientation, allowing the bolster assembly 32 to be moved without interference through the opening 61 between the columns 22,28. The installation of the same or another bolster 32,32' is carried out by reversing the above steps. Once the desired bolster assembly 32,32' is put in place, the slide assemblies 76,76' can be operated, either before or after the workpiece support elements 70,72 are pivoted to their operating orientation, to select the desired spacing for operation of the processing assembly 12. The bolster assembly 58 and nesting assembly 36' combination functions in the same manner, as described above.

While the invention has been described with particular reference to the drawings, it should be understood that various modifications could be made without departing from the spirit and scope of the present invention.

The invention claimed is:

1. A workpiece processing system comprising:

a first assembly for performing at least a first processing operation on a workpiece at a first processing location, the first assembly comprising a frame;

a nesting assembly;

a bolster assembly upon which a workpiece can be supported at the first processing location; and a transfer assembly, the bolster assembly repositionable relative to the frame by movement along a first path between first and second positions, the transfer assembly capable of moving a workpiece to/from the first processing location along a second path from/to the nesting assembly;

the nesting assembly comprising first and second workpiece support elements each having a length, the first and second workpiece support elements each repositionable relative to the bolster assembly in predetermined paths between (a) an operating orientation wherein the lengths of the first and second workpiece support elements project generally in a direction of the second path and (b) a stored orientation, the first and second workpiece support elements having a lesser projection along the second path with the first and second workpiece support elements in their stored orientation than with the first and second workpiece support elements in their operating orientation, at least one of the first and second workpiece support elements repositionable relative to the bolster assembly to a pre-storage position wherein the first and second workpiece support elements do not interfere with each other as the other of the first and second workpiece support elements is changed from its operating orientation into its stored orientation, wherein the first and second workpiece support elements are relatively repositionable between a pre-storage relationship and an operative relationship, wherein with the first and second workpiece support elements in the pre-storage relationship the first and second predetermined paths do not intersect and with the first and second workpiece support elements in the operative relationship the first and second predetermined paths do intersect.

2. The workpiece processing system according to claim 1 wherein the first and second workpiece support elements are movable respectively around first and second axes relative to the bolster in changing from their operating orientation into their stored orientation.

3. The workpiece processing system according to claim 2 wherein the first and second axes are substantially parallel to each other.

4. The workpiece processing system according to claim 2 wherein the second path extends substantially parallel to a first line and the first and second axes are substantially orthogonal to the first line.

5. The workpiece processing system according to claim 2 wherein the at least one of the first and second workpiece support elements is repositionable relative to the other of the first and second workpiece support elements so that the spacing between the first and second axes can be changed.

6. The workpiece processing system according to claim 5 wherein the first and second workpiece support elements are each translatable relative to the bolster assembly along a line so that the spacing between the first and second axes can be changed.

7. A workpiece processing system comprising:

a first assembly for performing at least a first processing operation on a workpiece at a first processing location, the first assembly comprising a frame;

a nesting assembly;

a bolster assembly upon which a workpiece can be supported at the first processing location; and a transfer assembly, the bolster assembly repositionable relative to the frame by movement along a first path between first and second positions, the transfer assembly capable of moving a workpiece to/from the first processing location along a second path from/to the nesting assembly;

the nesting assembly comprising first and second workpiece support elements each having a length, the first and second workpiece support elements each repositionable relative to the bolster assembly between (a) an operating orientation wherein the lengths of the first and second workpiece support elements project generally in a direction of the second path and (b) a stored orientation, the first and second workpiece support elements having a lesser projection along the second path with the first and second workpiece support elements in their stored orientation than with the first and second workpiece support elements in their operating orientation, at least one of the first and second workpiece support elements repositionable relative to the bolster assembly to a pre-storage position wherein the first and second workpiece support elements do not interfere with each other as the other of the first and second workpiece support elements is changed from its operating orientation into its stored orientation, wherein the first and second workpiece support elements are movable respectively around first and second axes relative to the bolster in changing from their operating orientation into their stored orientation, wherein the first and second workpiece support elements have first and second free ends respectively spaced from the first and second axes which trace first and second arcs as the first and second workpiece support elements move around the first and second axes between their operating and stored orientations and the first and second workpiece support elements are relatively repositionable between a pre-storage relationship and an operative relationship, wherein with the first and second workpiece support elements in the pre-storage relationship the first and second arcs do not intersect and with the first and second workpiece support elements in the operative relationship the first and second arcs do intersect.

8. A workpiece processing system comprising:

a first assembly for performing at least a first processing operation on a workpiece at a first processing location, the first assembly comprising a frame;

a nesting assembly;

a bolster assembly upon which a workpiece can be supported at the first processing location; and a transfer assembly, the bolster assembly repositionable relative to the frame by movement along a first path between first and second positions, the transfer assembly capable of moving a workpiece to/from the first processing location along a second path from/to the nesting assembly;

the nesting assembly comprising first and second workpiece support elements each having a length, the first and second workpiece support elements each repositionable relative to the bolster assembly between (a) an operating orientation wherein the lengths of the first and second workpiece support elements project generally in a direction of the second path and (b) a stored orientation, the first and second workpiece support elements having a lesser projection along the second path with the first and second workpiece support elements in their stored orientation than with the first and second workpiece support elements in their operating orientation, at least one of the first and second workpiece support elements repositionable relative to the bolster assembly to a pre-storage position wherein the first and second workpiece support elements do not interfere with each other as the other of the first and second workpiece support elements is changed from its operating orientation into its stored orientation, wherein the frame has a first opening, the bolster assembly moves through the first opening as the bolster assembly changes between the first and second positions, the first and second workpiece support elements are movable with the bolster assembly as the bolster assembly changes between the first and second positions, with the workpiece support elements in their operating orientation the first and second workpiece support elements are situated so as to interfere with the frame in the event that the bolster is moved between the first and second positions, and with the first and second workpiece support elements in their stored orientation, the first and second workpiece support elements do not interfere with the frame as the bolster assembly is moved between the first and second positions.

9. A workpiece processing system comprising:

a first assembly for performing at least a first processing operation on a workpiece at a first processing location, the first assembly comprising a frame;

a nesting assembly;

a bolster assembly upon which a workpiece can be supported at the first processing location; and a transfer assembly, the bolster assembly repositionable relative to the frame by movement along a first path between first and second positions, the transfer assembly capable of moving a workpiece to/from the first processing location along a second path from/to the nesting assembly;

the nesting assembly comprising first and second workpiece support elements each having a length, the first and second workpiece support elements each repositionable relative to the bolster assembly between (a) an operating orientation wherein the lengths of the first and second workpiece support elements project generally in a direction of the second path and (b) a stored orientation, the first and second workpiece support elements having a lesser projection along the second path with the first and second workpiece support elements in their stored orientation than with the first and second workpiece support elements in their operating orientation, at least one of the first and second workpiece support elements repositionable relative to the bolster assembly to a pre-storage position wherein the first and second workpiece support elements do not interfere with each other as the other of the first and second workpiece support elements is changed from its operating orientation into its stored orientation, wherein the first and second workpiece support elements each have a cantilevered construction with a free end, and the workpiece processing system further comprises a support bracket that is supportingly abuttable to the workpiece support elements adjacent to the free ends of the workpiece support elements with the workpiece support elements in their operating orientation.

10. The workpiece processing system according to claim 9 wherein the support bracket has an upwardly opening notch to receive the first workpiece support element.

11. The workpiece processing system according to claim 10 wherein the first workpiece support element is movable vertically relative to the support bracket to allow the notch to receive the first workpiece support element.

12. The workpiece processing system according to claim 11 wherein the bolster assembly is movable vertically relative to the frame and the first workpiece support element follows vertical movement of the bolster assembly.

13. The workpiece processing system according to claim 9 wherein the free end of the first workpiece support element has a depending portion which engages the support bracket.

14. The workpiece processing system according to claim 13 wherein the depending portion has a notch to receive the support bracket.

15. The workpiece processing system according to claim 1 further comprising a second assembly for performing at least a second processing operation on a workpiece at a second processing location.

16. The workpiece processing system according to claim 15 further comprising a shuttle assembly for moving workpieces between the first and second assemblies.

17. The workpiece processing system according to claim 1 further in combination with a workpiece on which a processing operation can be performed with the workpiece processing system.

18. A method of reconfiguring a workpiece processing system of the type comprising: a first assembly for performing at least a first processing operation on a workpiece at a first processing location and having a frame; a nesting assembly comprising first and second workpiece support elements each having a length and pivotable respectively about first and second axes in predetermined paths between operating and stored orientations; a bolster assembly upon which a workpiece can be supported at the first processing location; and a transfer assembly capable of moving a workpiece to/from the first processing location along a first path from/to the nesting assembly, the method comprising the steps of:

placing the first and second workpiece support elements in the operating orientation and in an operating relationship wherein (a) the lengths of the first and second workpiece support elements project generally in the direction of the first path, and (b) the predetermined paths intersect; and repositioning at least one of the first and second workpiece support elements relative to the bolster other than by pivoting around the first and second axes to place the first and second workpiece support elements in a pre-storage relationship wherein the first and second workpiece support elements are allowed to pivot from their operating orientation into their stored orientation without intersection of the predetermined paths.

19. A method of reconfiguring a workpiece processing system of the type comprising:

a first assembly for performing at least a first processing operation on a workpiece at a first processing location and having a frame; a nesting assembly comprising first and second workpiece support elements each having a length and pivotable respectively about first and second axes; a bolster assembly upon which a workpiece can be supported at the first processing location; and a transfer assembly capable of moving a workpiece to/from the first processing location along a first path from/to the nesting assembly, the method comprising the steps of:

placing the first and second workpiece support elements in an operating orientation wherein the lengths of the first and second workpiece support elements project generally in the direction of the first path; and repositioning at least one of the first and second workpiece support elements relative to the bolster other than by pivoting around the first and second axes to allow the first and second workpiece support elements to pivot from their operating orientation into their stored orientation without interfering with each other, wherein the step of repositioning at least one of the first and second support elements comprises moving the first workpiece support element so that the spacing between the first and second axes is changed.

20. The method of reconfiguring a workpiece processing system according to claim 18 wherein the step of repositioning at least one of the first and second support elements comprises translating the first and second workpiece support elements along a line.

21. The method of reconfiguring a workpiece processing system according to claim 18 wherein the step of repositioning at least one of the first and second support elements comprises translating the first and second workpiece support elements along a substantially horizontal line that is orthogonal to the first axis.

22. The method of reconfiguring a workpiece processing system according to claim 18 further comprising the step of moving the bolster assembly and the nesting assembly as a unit relative to the frame along a second path that is transverse to the first path between a first position at the first processing location and a second position that is spaced from the first processing location, with the first and second workpiece support elements in their stored orientation.

23. A method of reconfiguring a workpiece processing system of the type comprising: a first assembly for performing at least a first processing operation on a workpiece at a first processing location and having a frame; a nesting assembly comprising first and second workpiece support elements each having a length and pivotable respectively about first and second axes; a bolster assembly upon which a workpiece can be supported at the first processing location; and a transfer assembly capable of moving a workpiece to/from the first processing location along a first path from/to the nesting assembly, the method comprising the steps of:

placing the first and second workpiece support elements in an operating orientation wherein the lengths of the first and second workpiece support elements project generally in the direction of the first path; and repositioning at least one of the first and second workpiece support elements relative to the bolster other than by pivoting around the first and second axes to allow the first and second workpiece support elements to pivot from their operating orientation into their stored orientation without interfering with each other, wherein the step of repositioning at least one of the first and second support elements comprises translating the first and second workpiece support elements along a line that is orthogonal to the first axis and transverse to the first path.

24. A workpiece processing system comprising:

a first assembly for performing at least a first processing operation on a workpiece at a first processing location, the first assembly comprising a frame;

a nesting assembly;

a bolster assembly upon which a workpiece can be supported at the first processing location; and a transfer assembly, the bolster assembly repositionable relative to the frame by movement along a first path between first and second positions, the transfer assembly capable of moving a workpiece to/from the first processing location along a second path from/to the nesting assembly;

the nesting assembly comprising first and second workpiece support elements each having a length, the first and second workpiece support elements each repositionable relative to the bolster assembly between (a) an operating orientation wherein the lengths of the first and second workpiece support elements project generally in a direction of the second path and (b) a stored orientation, the first and second workpiece support elements having a lesser projection along the second path with the first and second workpiece support elements in their stored orientation than with the first and second workpiece support elements in their operating orientation, at least one of the first and second workpiece support elements repositionable relative to the bolster assembly in a direction transversely to the second path to a pre-storage position wherein the first and second workpiece support elements do not interfere with each other as the other of the first and second workpiece support elements is changed from its operating orientation into its stored orientation.

* * * * *